US005178939A

United States Patent [19]

Caldwell

[11] Patent Number: 5,178,939

[45] Date of Patent: Jan. 12, 1993

[54] FABRIC COVERED RIGID STRUCTURE AND PROCESS OF MANUFACTURE

[75] Inventor: Kenneth G. Caldwell, Mountville, Pa.

[73] Assignee: Armstrong World Industries, Inc., Lancaster, Pa.

[21] Appl. No.: 792,125

[22] Filed: Dec. 12, 1991

Related U.S. Application Data

[63] Continuation of Ser. No. 622,202, Nov. 29, 1990, abandoned.

[51] Int. Cl.[5] ..... B05D 3/00

[52] U.S. Cl. ..... 428/296; 428/224; 428/360

[58] Field of Search ..... 428/221, 224, 296, 360

*Primary Examiner*—Patrick J. Ryan
*Assistant Examiner*—Richard P. Weisberger

[57] ABSTRACT

A novel fabric-covered wall- or ceiling-board of improved abrasion resistance is disclosed. The fabric is composed of fibers of at least two different melting temperatures. The product is manufactured by heating the fabric to a temperature to soften one fiber but not the other and bonding the fabric to the board.

4 Claims, 1 Drawing Sheet

FABRIC COVERED RIGID STRUCTURE AND PROCESS OF MANUFACTURE

CROSS-REFERENCE TO RELATED APPLICATION

This is a continuation of application Ser. No. 07/622,202, filed Nov. 29, 1990, now abandoned.

BACKGROUND OF THE INVENTION

1. Field of the Invention

This invention relates to a carpet-faced wall or ceiling structure and, more particularly, to the use of a non-woven felted fabric as the facing for an acoustical wallboard.

2. Description of the Prior Art

It is not unusual in many countries to use carpeting as a covering for walls. The carpeting may be hung adjacent to the wall structure or permanently affixed to the wall. To minimize expense, it is preferred to employ a felted non-woven fabric affixed to a panel structure. Such structures are disclosed in U.S. Pat. Nos. 2,639,658 and 2,839,442.

U.S. Pat. No. 3,920,872 discloses the bonding of a needle-bonded carpet material to sheets of perforated fiberboard in a manner such that the perforations are not obstructed.

U.S. Pat. No. 3,924,040 discloses the use of a woven or non-woven scrim to which a non-woven felted fabric is needle-bonded before it is embossed to make a patterned wall covering.

U.S. Pat. No. 4,473,609 discloses the use of a scrim, to which is needle-bonded a non-woven felted fabric material. A decorative pattern is then embossed on the composite product. The heat of embossing causes the needle-bonded felted fabric in the embossed areas to partially melt and take on a texturing that mirrors the configuration of the scrim.

The object of the present invention is to provide a non-woven felted fabric of improved abrasion resistance. A further object is to provide such a fabric affixed by adhesion or otherwise bonded to a fiberboard or other substantially rigid backing. A still further object is to provide a novel fabric-covered wallboard of improved abrasion resistance.

SUMMARY OF THE INVENTION

The objects are accomplished by bonding a non-woven felted fabric wherein the major portion of the non-woven fibers of the fabric are interlocked by means of a minor portion of fibers of lower melting point to the surface of a rigid structure. Specifically, the objects are accomplished by blending 2–50%, preferably 2–20% of the lower melting fibers with, correspondingly, 50–98%, preferably 80–98% of the higher melting fibers; forming a non-woven fabric by a standard carding and needlepunch operation; and heating the fabric to a temperature between the melting temperature of the lower melting fibers and the melting temperature of the higher melting fibers for a sufficient time to soften the lower melting fibers and to cause them to bond the higher melting fibers together and bonding the fabric to the surface of a rigid structure. The resulting fabric displays a substantial improvement in abrasion resistance over a non-woven fabric prepared without the lower melting fibers as measured by the abrasion test described hereinafter.

The preferred high melting fiber in current use is the polyester, polyethylene terephthalate (PET), which has a normal melting temperature of about 485° F. Other fibers that may be used to prepare the non-woven felted fabric include other polyesters, nylon or other polyamides, acrylic, cotton or wool fibers.

The preferred low melting fiber is polypropylene which has a normal melting temperature of about 310° F. Other low melting fibers include any staple fiber having a melting temperature preferably at least 10° F. below the melting temperature of the high melting fiber such as polyethylene, polyvinyl chloride, lower melting polyester, i.e. polyethylene terephthalate of lower molecular weight or another lower melting polyester.

Specifically, a non-woven fabric is produced from the high melting fiber/low melting fiber blend by a conventional carding and needlepunch operation as shown in U.S. Pat. No. 4,473,609, except that no scrim is used in the preferred embodiment of this invention. The disclosure of U.S. Pat. No. 4,473,609, particularly regarding the carding machine and the needle loom operations described therein, are incorporated herein by reference. Specifically, a carding machine manufactured by the Hergerth-Hollingsworth Company and a needle loom manufactured by the Dilo Company were used.

The resulting fabric is then exposed to a thermal consolidation process such as calendering or thermal transfer printing wherein the temperature attained by the fabric exceeds the melting or softening temperature of the low melting fiber but is below, preferably at least 10° F. below the melting or softening temperature of the high melting fiber. At this temperature, the low melting fiber softens and tends to surround the intersections of the high melting felted fibers. Upon heating, the high melting fibers are substantially interlocked. The resulting fabric may be bonded to an acoustical fiberboard as described in U.S. Pat. Nos. 3,920,872; 3,924,040; 4,222,803; or 4,473,609, the disclosure of which patents are incorporated by reference herein.

BRIEF DESCRIPTION OF THE DRAWINGS

In FIGS. 1 and 2, the wallboard structure is composed of a rigid base structure or board 2, which is usually a fiberboard structure, and a fabric facing 1 placed on the surface of board 2.

Figure 1:
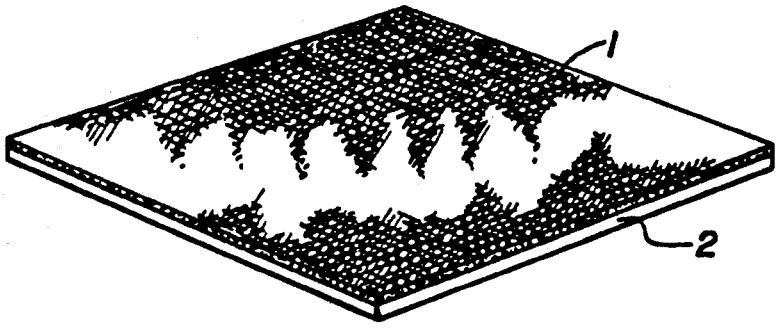
FIG. 1 is a view, in perspective, of the product of this invention.
Figure 2:
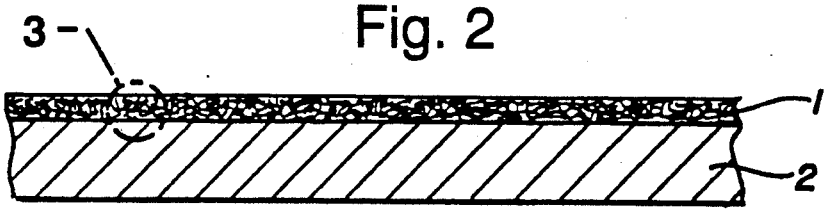
FIG. 2 is a view, in cross-section, of the product of this invention.

A conventional fiberboard structure is utilized as the base 2 for the wallboard invention herein. This fiberboard structure may be any of the conventional mineral wool or wood fiber panel structures which are currently available on the open market. The base structure 2 is provided with a perforated surface wherein the perforations in the surface provide acoustical pockets to increase the sound absorption ability of the base structure surface. An adhesive coating is placed upon the perforated surface in such a manner as not to close over the perforation openings on the base surface. A carpet material 1 is provided with a latex tie coat on the back surface thereof. The latex tie coat is placed on the carpet surface to provide a discontinuous film on the back of the carpet surface. The carpet material 1 is then applied to the perforated surface of the base material 2, and the adhesive on the base material and the tie coat on the carpet backing bond the base material 2 and carpet facing 1 together to form the carpet-faced fiberboard which is now capable of being used as a wallboard.

Although conventional sound absorbing boards have been described for use in the invention, it should be understood that other materials may be used. Thus, the fabric may be bonded to gypsum "dry wall" or fiberglass structures, to plastic walls or ceilings, to wood panels, etc. Typical of the boards are those sold under the Armstrong World Industries, Inc. trademarks as "Minaboard" or "Silok".

The carpet material 1 of the polyester/polypropylene blend, prepared as described previously, may be applied directly to the surface of the board 2 or by first applying the fabric to the surface of a woven scrim as described in U.S. Pat. No. 4,473,609. In either case, the surface of the board may be roll coated with an adhesive as described previously to bond the carpet fabric 1 firmly to the board 2. In the enlargement in FIG. 3, the details of the carpet fabric 1 are more clearly presented. The polyester fibers 3, which have been needled together by the conventional needle-bonding technique, are further interlocked by the lower melting polypropylene 4.

Figure 3:
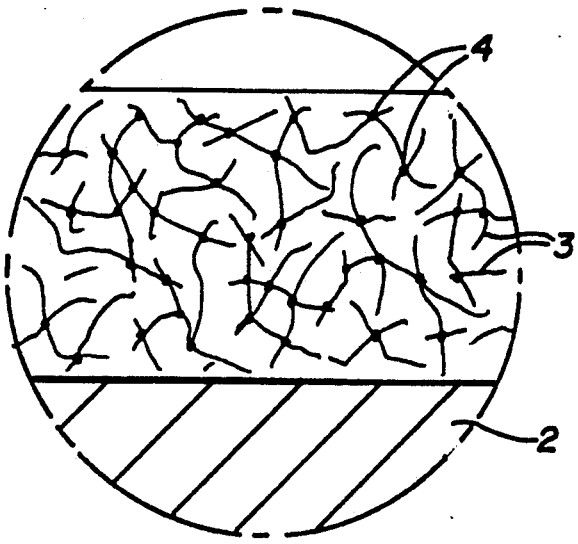
FIG. 3 is a magnified viewing of the cross-section of the product of the invention.

The process of forming the final carpet-covered wallboard structure is substantially as shown in FIG. 3 of U.S. Pat. No. 4,473,609. The fibers of high and relatively low melting temperatures are first blended in a blender. From the blender, the fibers are fed into the carding and needlepunch equipment. The non-woven fabric is transfer printed at 410° F., 5 PSI pressure at a 30 second dwell time in a flat press printer.

The back of the carpet may be sprayed with a latex tie coat before it is bound to the base board in an adhesive press.

The advantages of the invention will be more clearly understood by referring to the example which follows. In the example, abrasion resistance of the fabric was determined by using a fine sandpaper foot in a motor driven crockmeter. Specifically, ten and twenty strokes were applied to the fabric in a Standard Mechanical AATCC Crockmeter manufactured by Atlas Electric Devices (Model CM-5). Sandpaper (Grit #150) had been placed on the rubbing foot. The samples were rated on a visual 0–5 scale for each of the individual ten and 20 stroke areas. The "5" signifies no visual change due to abrasion while "0" signifies severe abrasion.

EXAMPLE 1

A 4% polypropylene blend with PET is carded and needlepunched into an 7.8 oz/yd$^2$ non-woven fabric on the card-and-needleloom. The fabric is then backed with 3.0 oz/yd$^2$ of a conventional latex backing (a vinyl acrylic pressure sensitive backing) and transfer printed with a flannel pattern transfer paper on a flat press. The transfer conditions were 410° F., 5 PSI, and 20 second dwell time.

As a control, a similarly backed fabric of 100% polyester fiber was prepared on the card-and-needle-loom. It also was composed of 7.8 oz/yd$^2$ non-woven fabric and 3.0 oz/yd$^2$ of latex backing; and was subjected to the identical transfer printing step using the flannel pattern.

The resulting fabric in Example 1 is a flannel-like material with much improved abrasion resistance compared to the similarly prepared fabric of 100% polyester of the control when both were subjected to the previously-mentioned abrasion test.

Specifically, the fabrics were rated from "5" (no abrading) to "0" (severe abrading) after ten and twenty strokes of the crockmeter, as follows:

| | % PP | 10 Strokes | 20 Strokes |
|---|---|---|---|
| Example 1 | 4 | 4 | 3 |
| Control | 0 | 2 | 1 |

It should be noted that the most preferred percentages of low melting fiber in the fiber blends used in the present invention is from 4% to 15% by weight of the blend. Four percent appears to be a minimum for obtaining adequate interlocking after transfer printing for significant improvement in abrasion resistance; and 15% appears to be a maximum for maintaining the quality of the fabric after transfer printing. Above 15% may result in the transfer paper sticking to the fabric and/or the appearance of a plastic film on the fabric's surface instead of the desired textured surface.

What is claimed is:

1. A wallboard structure comprising a substantially rigid fiberboard base and a fibrous carpet material bonded to a surface of said fiberboard base, said carpet material being a non-woven felted fabric of interlocked bonded fibers composed of 2–15% relatively low melting fibers and 85–98% relatively high melting fibers, the high melting fibers having a melting temperature at least 10° F. greater than the melting temperature of the low melting fibers, said high melting fibers being bonded at the contact points with said low melting fibers substantially throughout said fabric.

2. The structure of claim 1 wherein said high melting fibers are polyethylene terephthalate fibers and said low melting fibers are polypropylene.

3. The structure of claim 1 wherein said substantially rigid base is selected from the group consisting of a mineral wool panel, a wood fiber panel and a fiberglass panel.

4. The structure of claim 3 composed of 4–15% of relatively low melting fibers.

* * * * *

UNITED STATES PATENT AND TRADEMARK OFFICE

CERTIFICATE OF CORRECTION

PATENT NO. : 5,178,939

DATED : January 12, 1993

INVENTOR(S) : Kenneth G. Caldwell

It is certified that error appears in the above-identified patent and that said Letters Patent is hereby corrected as shown below:

Col. 4, line 53, claim 4, "claim 3" should read --claim 2--.

Signed and Sealed this

Twenty-sixth Day of October, 1993

*Attest:*

Bruce Lehman

BRUCE LEHMAN

*Attesting Officer*

*Commissioner of Patents and Trademarks*